US009180685B1

(12) United States Patent
Masuda

(10) Patent No.: US 9,180,685 B1
(45) Date of Patent: Nov. 10, 2015

(54) PRINTER APPARATUS

(71) Applicant: TOSHIBA TEC KABUSHIKI KAISHA, Shinagawa-ku, Tokyo (JP)

(72) Inventor: Ken Masuda, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/529,321

(22) Filed: Oct. 31, 2014

(51) Int. Cl.
*B41J 3/28* (2006.01)
*B41J 3/54* (2006.01)

(52) U.S. Cl.
CPC ..... *B41J 3/28* (2013.01)

(58) Field of Classification Search
CPC ..... B41J 15/22; B41J 15/24; B41J 11/0045; B41J 3/28
USPC ..... 347/104, 110
See application file for complete search history.

(56) References Cited

U.S. PATENT DOCUMENTS 4,600,828 A * 7/1986 Nogami et al. ..... 235/379
5,017,026 A * 5/1991 Takesako et al. ..... 400/24

FOREIGN PATENT DOCUMENTS

JP 2010-214617 9/2010

* cited by examiner

*Primary Examiner* — Stephen Meier
*Assistant Examiner* — Alexander D Shenderov
(74) *Attorney, Agent, or Firm* — Amin, Turocy & Watson, LLP

(57) ABSTRACT

A printer apparatus comprises an insertion and discharging port; a first paper conveyance path configured to convey a first printing medium in a form of booklet inserted from the insertion and discharging port in a downstream direction towards a given printing position, and convey the first printing medium in a direction opposite to the downstream direction to discharge the first printing medium from the insertion and discharging port; a first printing section configured to carry out printing on the first printing medium conveyed to the printing position; a second printing section configured at the downstream side of the first printing section when seen from the direction of the insertion and discharging port to carry out printing on a second printing medium in a printing method different from that of the first printing section; a second paper conveyance path configured to merge with the first paper conveyance path at the downstream side of the first printing section of the first paper conveyance path to discharge the printed second printing medium through the first paper conveyance path from the insertion and discharging port; and a new booklet issuing section configured to insert an unused first printing medium in the second paper conveyance path as a newly issued medium.

4 Claims, 5 Drawing Sheets

PRINTER APPARATUS

FIELD

Embodiments described herein relate to a printer apparatus having a booklet issuing function.

BACKGROUND

In an ATM (AUTOMATED TELLER MACHINE) device of a bank and the like, printing is carried out on a passbook of a customer by a dot impact printing mechanism, and when a business form such as a transaction description and the like is issued, printing is carried out on thermal paper loaded in the printer apparatus by a thermal printing mechanism. There is a request to reduce the size of the ATM device, and in recent years, it has been known to arrange different printing mechanisms (dot impact printing mechanism and thermal printing mechanism) in the ATM device and share the conveyance path.

In a case where there remains data to be printed even though the printing is carried out in the last page of the passbook, it is needed to update the passbook to a new passbook. In this case, a user goes to the window of the bank and the like to update the passbook to a new passbook. However, there exists a case where the user needs to update the passbook to a new passbook during a time period when the window is not opened. Thus, there is known a new passbook issuing machine. However, there is a problem that such a dedicated new passbook issuing machine occupies a wide area.

DETAILED DESCRIPTION

In accordance with one embodiment, a printer apparatus comprises an insertion and discharging port; a first paper conveyance path configured to convey a first printing medium in a form of booklet inserted from the insertion and discharging port in a downstream direction towards a given printing position, and convey the first printing medium in a direction opposite to the downstream direction to discharge the first printing medium from the insertion and discharging port; a first printing section configured to carry out printing on the first printing medium conveyed to the printing position; a second printing section configured at the downstream side of the first printing section when seen from the direction of the insertion and discharging port to carry out printing on a second printing medium in a printing method different from that of the first printing section; a second paper conveyance path configured to merge with the first paper conveyance path at the downstream side of the first printing section of the first paper conveyance path to discharge the printed second printing medium through the first paper conveyance path from the insertion and discharging port; and a new booklet issuing section configured to insert an unused first printing medium in the second paper conveyance path as a newly issued medium.

Hereinafter, the printer apparatus according to one embodiment is described in detail with reference to the accompanying drawings.

Figure 1:
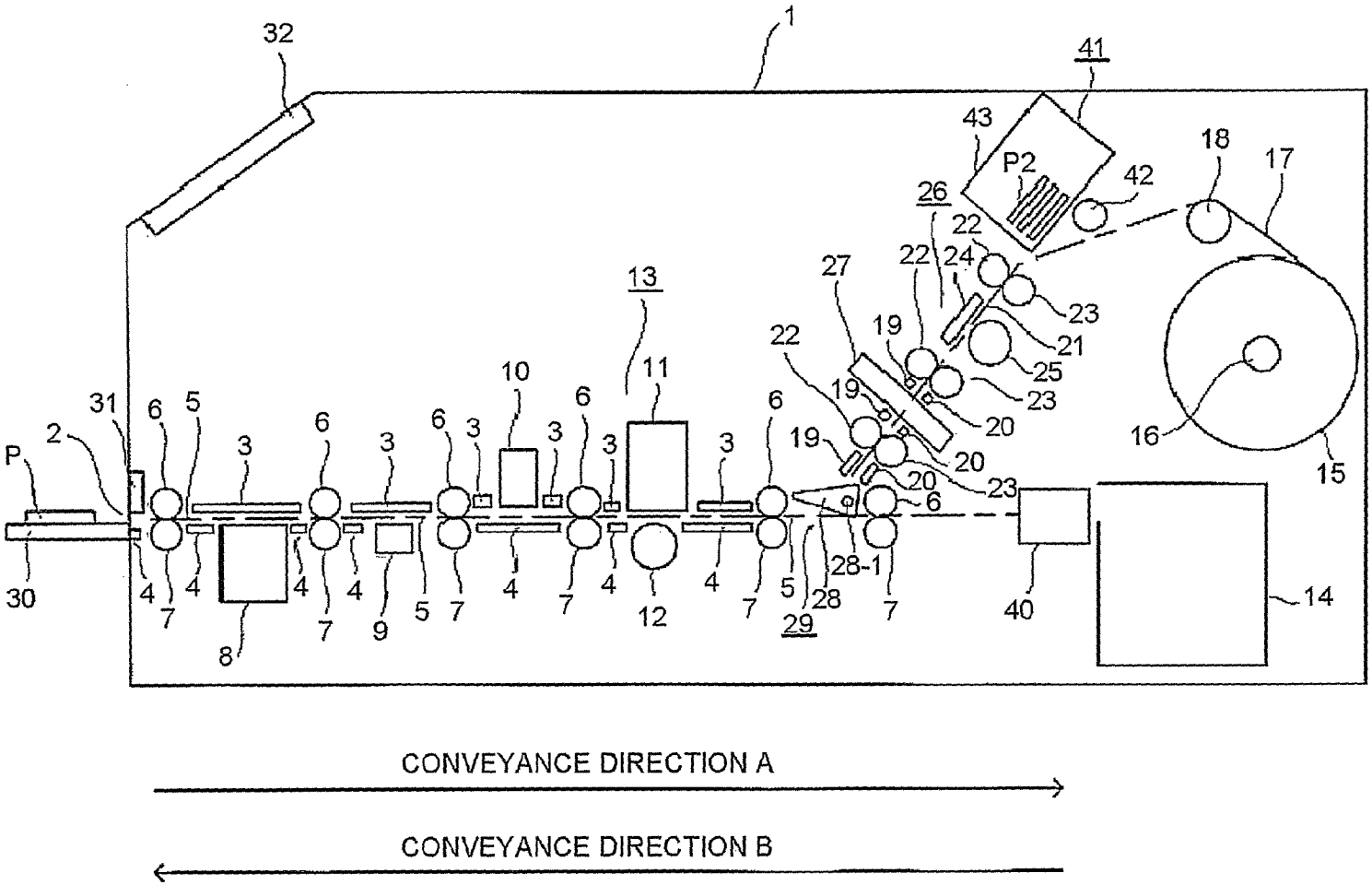
FIG. 1 is a constitution diagram illustrating the main portions of a printer apparatus according to one embodiment.

FIG. 1 is a constitution diagram illustrating the main portions of the printer apparatus according to the embodiment.

A printer apparatus 1 includes a plurality of different printing mechanisms. In addition, in the following description of the present embodiment, the left side in FIG. 1 is referred to as a front side of the printer apparatus 1, and the right side in FIG. 1 is referred to as a rear side of the printer apparatus 1.

At the front side of the printer apparatus 1, an insertion and discharging port 2 is arranged for inserting a booklet P such as a passbook, or discharging the printed booklet P such as a passbook or later-described roll paper 15 issued as a business form which is cut after the printing is completed to the outside of the printer apparatus 1. In the present embodiment, the roll shape paper is referred to as the roll paper 15 and the business form obtained by cutting the roll paper 15 after required items are printed on the roll paper 15 is referred to as a business form C.

A collection box 14 is arranged at the rear side of the printer apparatus 1 to collect and store the booklet P and the business form C a user forgets to take.

A first conveyance upper guide 3 and a first conveyance lower guide 4 are arranged to extend in the space from the insertion and discharging port 2 to the collection box 14, and the space between the first conveyance upper guide 3 and the first conveyance lower guide 4 is regarded as a first paper conveyance path 5 for conveying the booklet P and the business form C. In the description of the present embodiment, the direction of the conveyance of the booklet P or the business form C from the insertion and discharging port 2 towards the collection box 14 is referred to as a conveyance direction A, and the left side in FIG. 1 (that is, the front side) is referred to as an upstream side and the right side is referred to as a downstream side unless otherwise noted.

At the downstream side of the insertion and discharging port 2 in the conveyance direction A, a feed roller 6 which can be rotated by a motor (not shown) is arranged opposite to an idler roller 7 across the first paper conveyance path 5. The feed roller 6 and the idler roller 7 are in pairs, so as to clamp and convey the booklet P and the business form C. A plurality of pairs of feed roller 6 and idler roller 7 are arranged along the first paper conveyance path 5.

Further, an alignment section 8 is arranged at the downstream side of the insertion and discharging port 2 in the conveyance direction A. The alignment section 8 consisting of a paper position detection sensor, a shutter, a paper pinch mechanism, an alignment end wall (none is shown) and the like corrects the skew, misalignment and the like of the booklet P inserted from the insertion and discharging port 2 and moves the booklet P to a preset position and attitude.

A MS (MAGNETIC STRIPE) reading/writing section 9 is arranged at the downstream side of the alignment section 8 in the conveyance direction A. The MS reading/writing section 9 carries out information reading and writing processing with a magnetic stripe section (not shown) arranged at the back side of the booklet P.

A PLF (PAGE LINE FINDER) section 10 is arranged at the downstream side of the MS reading/writing section 9 in the conveyance direction A. The PLF section 10 confirms the current opened page of the booklet P.

At the downstream side of the PLF section 10 in the conveyance direction A, a dot head 11 is arranged opposite to a platen roller 12 across the first paper conveyance path 5. The dot head 11 and the platen roller 12 constitute a first printing section 13 which carries out printing on the booklet P.

A page turning mechanism 40 for turning the page of the booklet P is arranged at the downstream side of the first printing section 13 in the conveyance direction A, and the collection box 14 is arranged at the downstream side of the page turning mechanism 40 in the conveyance direction A.

At the rear side of the printer apparatus 1, the roll paper 15 serving as paper wound around a winding shaft 16 which is supported in a rotatable manner to a frame (not shown) is loaded.

The roll paper 15 includes a thermosensitive layer which generates color if heated only on a printing surface A17 serving as one surface thereof.

Further, an idler roller 18 is arranged in the printer apparatus 1 to apply a given tension to the roll paper 15.

A second paper conveyance path 21 is arranged from the idler roller 18 towards the front side of the printer apparatus 1, and the second paper conveyance path 21 merges with the first paper conveyance path 5 at a position between the first printing section 13 and the page turning mechanism 40 on the first paper conveyance path 5. In the description of the present embodiment, the mergence position of the first paper conveyance path 5 and the second paper conveyance path 21 is referred to as a mergence section 29, and the direction of the conveyance of the roll paper 15 or the business form C and the later-described newly issued booklet P2 from the idler roller 18 via the mergence section 29 towards the insertion and discharging port 2 is referred to as a conveyance direction B.

A feed roller 22 which can be rotated by a motor (not shown) and an idler roller 23 are arranged along the second paper conveyance path 21. The feed roller 22 and the idler roller 23 are arranged opposite to each other across the second paper conveyance path 21, and if the feed roller 22 is rotated, the roll paper 15, the business form C and the newly issued booklet P2 clamped between the feed roller 22 and idler roller 23 are conveyed. A plurality of pairs of feed roller 22 and idler roller 23 are arranged along the second paper conveyance path 21.

A second conveyance upper guide 19 and a second conveyance lower guide 20 are arranged along the second paper conveyance path 21, and the space between the second conveyance upper guide 19 and the second conveyance lower guide 20 is used as the second paper conveyance path 21 for conveying the roll paper 15, the business form C and the newly issued booklet P2.

At the downstream side of the idler roller 18 in the conveyance direction B, a thermal print head 24 is arranged opposite to a platen roller 25 which can be rotated by a motor (not shown) across the second paper conveyance path 21. The thermal print head 24 and the platen roller 25 constitute a second printing section 26 which carries out printing on the printing surface A17 of the roll paper 15.

A cutter 27 is arranged at the downstream side of the second printing section 26 in the conveyance direction B. The cutter 27 includes a fixed blade and a movable blade neither of which is shown, and cuts the roll paper 15 inserted in a slit (not shown) arranged in the cutter 27 by sliding and moving the movable blade towards the fixed blade under the driving of a cutter motor (not shown). The cutter 27, which is not limited to a slide type cutter sliding the movable blade towards the fixed blade described herein, may also be a rotary type cutter cutting paper by rotating the movable blade towards the fixed blade.

The first paper conveyance path 5 and the second paper conveyance path 21 merges with each other at the downstream side of the cutter 27 in the conveyance direction B. A flapper 28 is arranged in the mergence section 29 serving as the mergence position. The flapper 28 can be rotated around a flapper rotation shaft 28-1; if the flapper 28 is rotated anticlockwise, the second paper conveyance path 21 is communicated with the first paper conveyance path 5, and if the flapper 28 is rotated clockwise, the paper can be conveyed only on the first paper conveyance path 5 from the insertion and discharging port 2 to the collection box 14. Usually, the flapper 28 is energized clockwise by an energization module (not shown), thus, the paper can be conveyed on the first paper conveyance path 5 from the insertion and discharging port 2 to the collection box 14. A flapper rotation mechanism (not shown) is driven to rotate the flapper 28 anticlockwise to communicate the second paper conveyance path 21 with the first paper conveyance path 5.

Further, at the front side of the printer apparatus 1 nearby the insertion and discharging port 2, an insertion and discharging table 30 is arranged for temporarily placing the booklet P or the business form C when inserting the booklet P into the printer apparatus 1 or when discharging the booklet P or the business form C towards the user. A collection sensor 31 is arranged at the insertion and discharging port 2 to detect whether or not the booklet P or the business form C is taken by the user. Further, a display section 32 is arranged at the upper portion of the printer apparatus 1 to display various states of the printer apparatus 1, including an error such as a paper jam, paper out and the like.

Further, a new booklet issuing section 41 is arranged at the upstream side of the second printing section 26 in the conveyance direction B. The new booklet issuing section 41 is provided with a booklet holder 43, a feed roller 42, and the like. The newly issued booklet P2 held in the booklet holder 43 is conveyed by the feed roller 42 towards the second paper conveyance path 21 from the lower end. In addition, the new booklet issuing section 41 can be attached to and detached from the printer apparatus 1 freely, and even in a case where the new booklet issuing section 41 is not needed and is therefore detached from the printer apparatus 1, the printer apparatus 1 can be operated as well.

Figure 2:
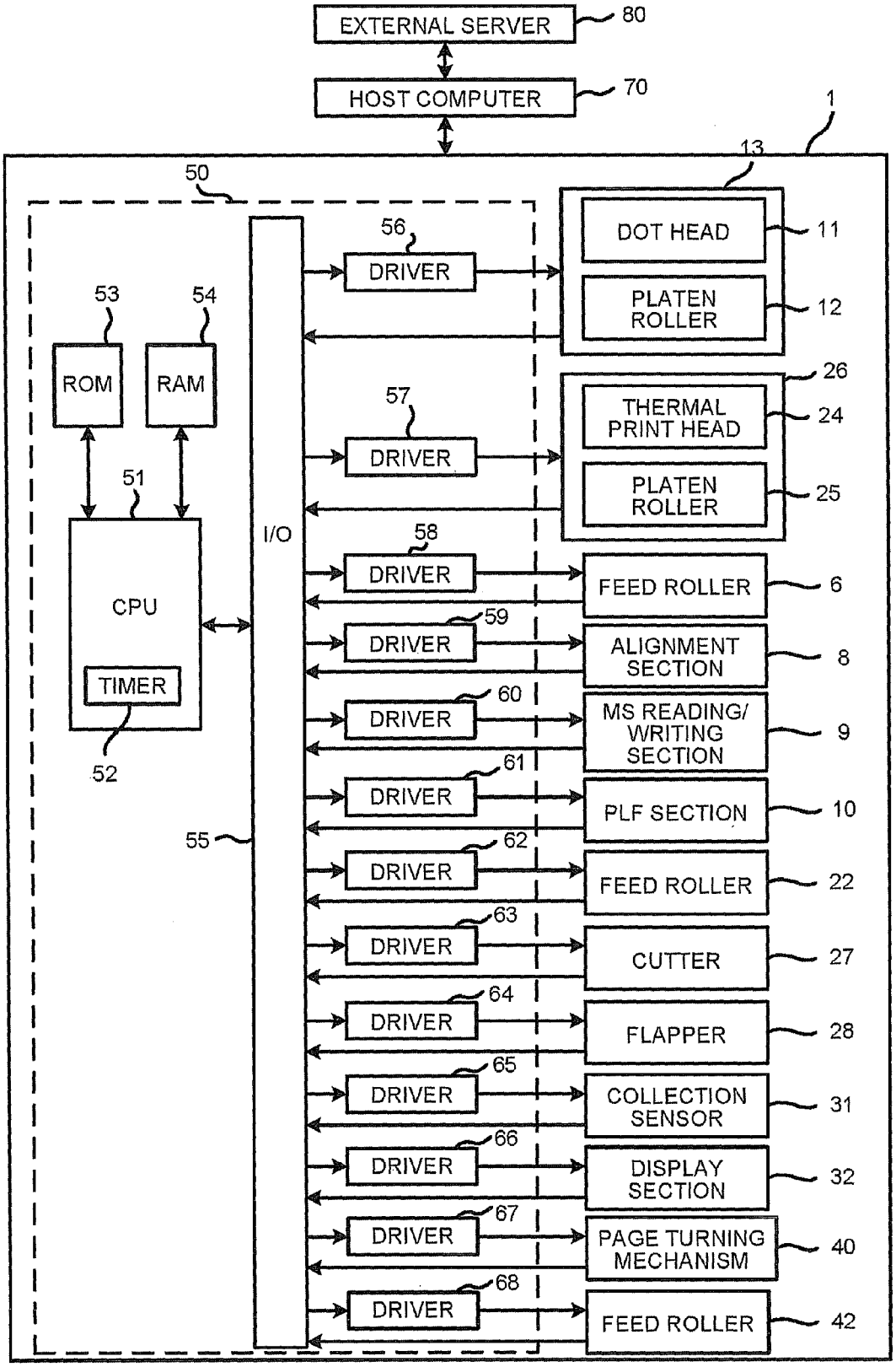
FIG. 2 is a control block diagram of the printer apparatus according to the present embodiment.
Figure 3:
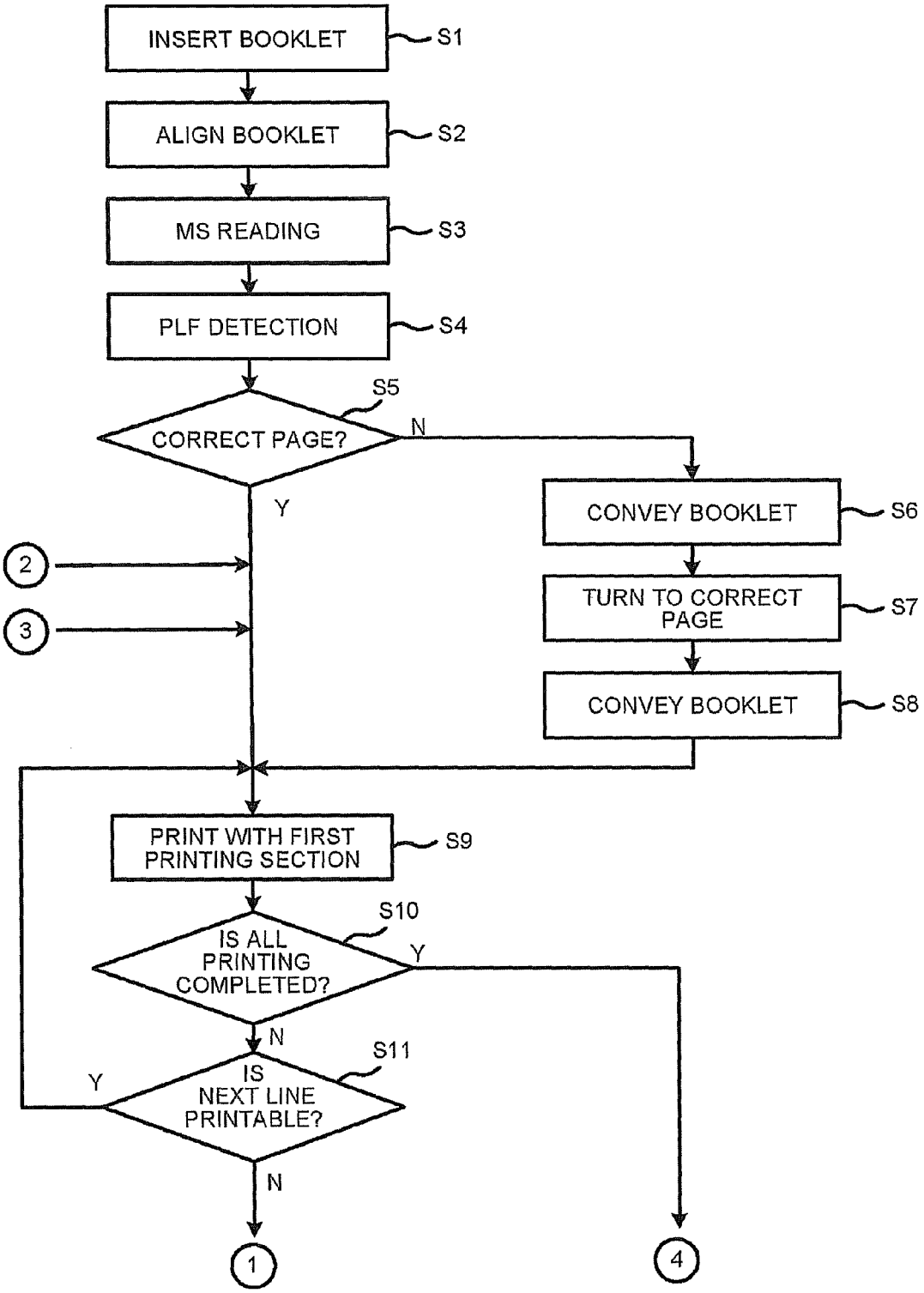
FIG. 3 is a flowchart illustrating the operations of the printer apparatus which carries out printing on a booklet and a business form, and issues a new booklet according to the present embodiment.
Figure 4:
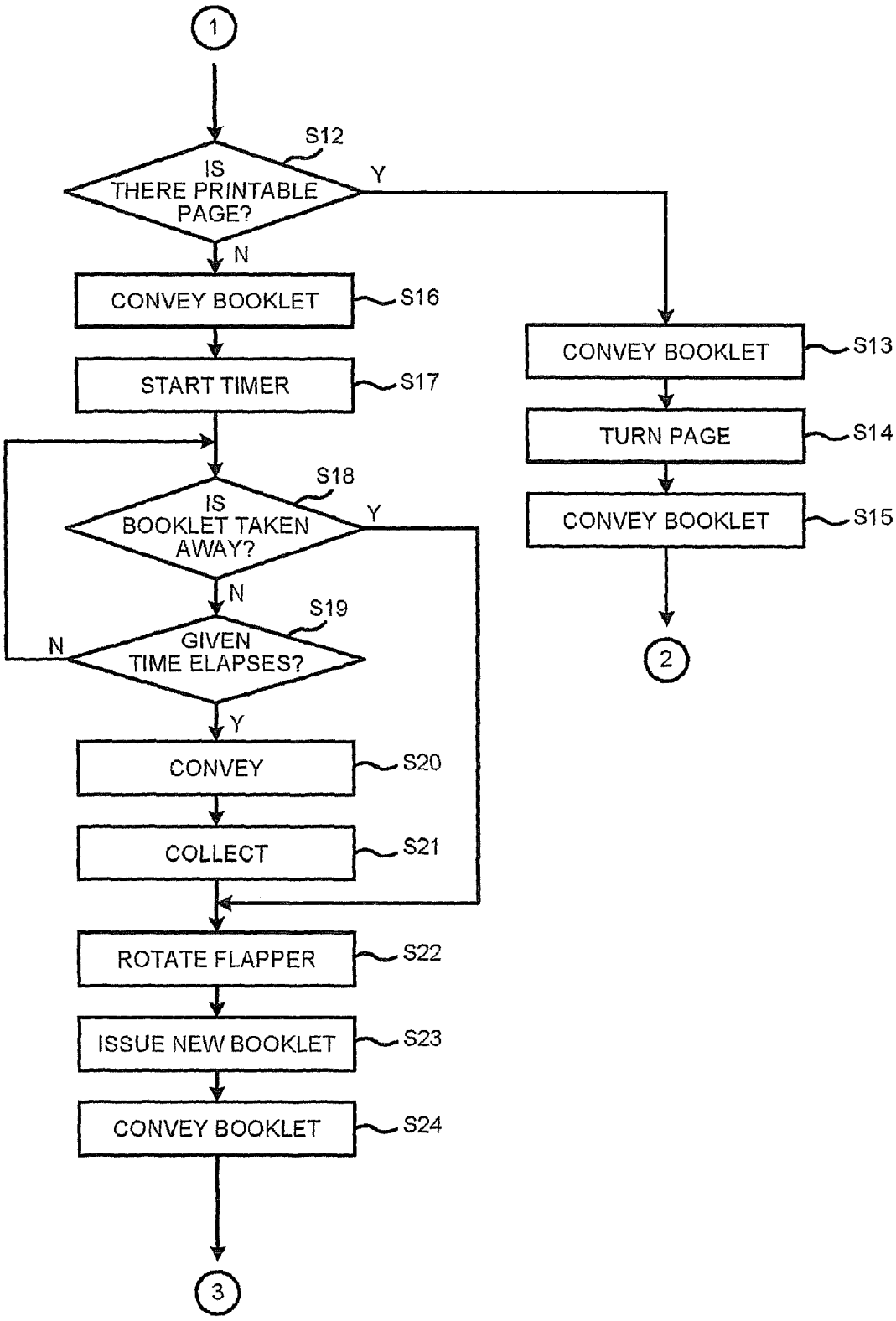
FIG. 4 is a flowchart illustrating the operations of the printer apparatus which carries out printing on a booklet and a business form, and issues a new booklet according to the present embodiment.
Figure 5:
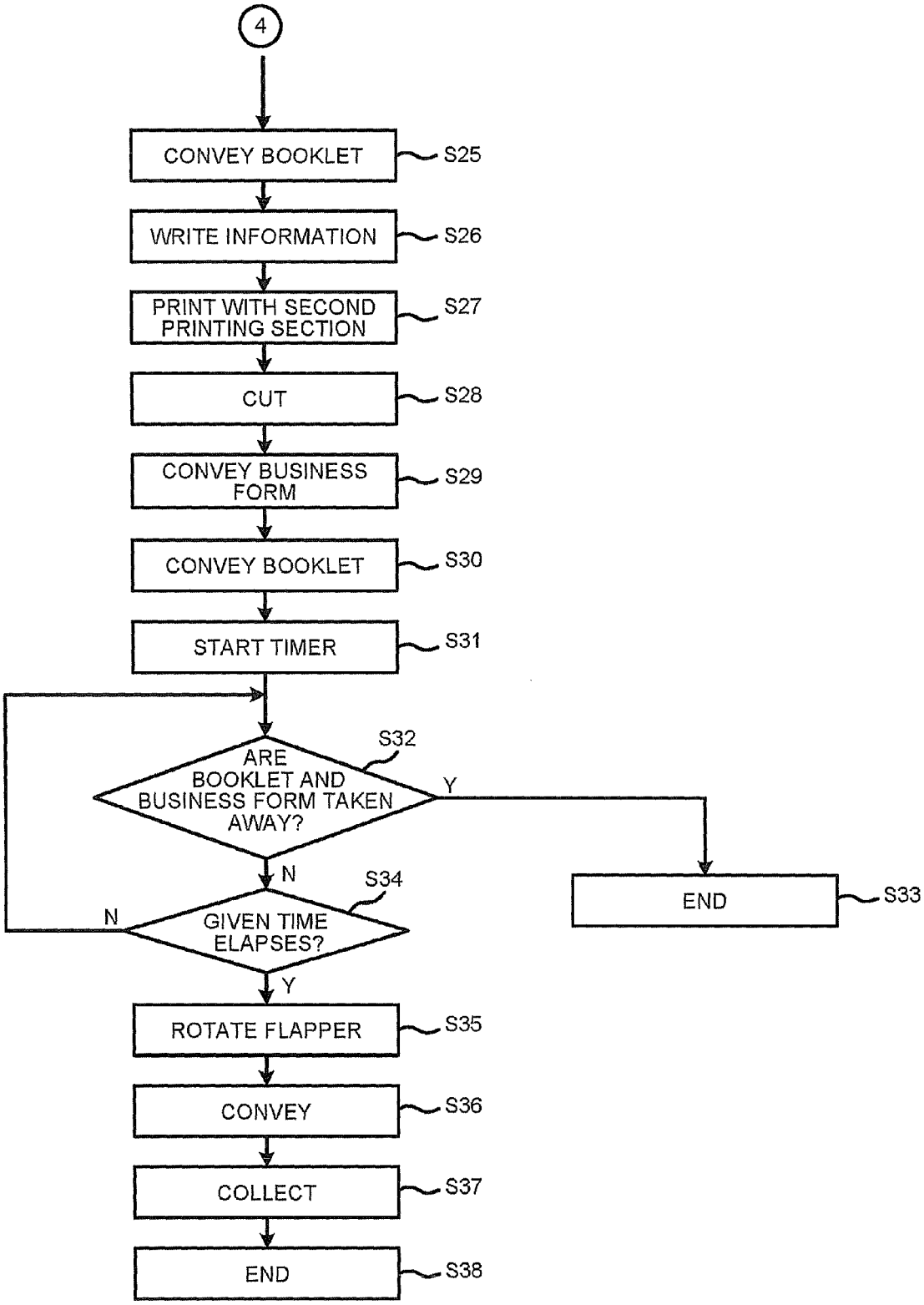
FIG. 5 is a flowchart illustrating the operations of the printer apparatus which carries out printing on a booklet and a business form, and issues a new booklet according to the present embodiment.

FIG. 2 is a block diagram illustrating the constitution of a control circuit of the printer apparatus 1 according to the present embodiment. A control section 50 carries out controls on paper conveyance, printing, paper cutting, paper discharging, paper collection, condition display of the printer apparatus, page turning of the booklet and the issuance of new booklet.

The control section 50 is constituted by, for example, a micro-computer which carries out connection with a host computer 70 and the execution of various controls. The host computer 70 is connected with an external server 80 such as a financial institution managing the saving deposit information and the like.

A central processing unit (CPU) 51 of the control section 50 carries out, according to programs, various operations and various controls such as paper conveyance control, printing control, paper cutting control, paper discharging control and paper collection control, booklet page turning control, new booklet issuing control and the like.

The CPU 51 comprises a timer 52 serving as a unit for carrying out time setting and time control.

A ROM 53 and a RAM 54 are arranged in the control section 50 as primary storage units for storing control programs executed by the CPU 51 and data generated during a control process or an operation process.

The ROM 53 is a read-only memory in which control programs and tables and the like are stored, and the RAM 54 is a random access memory for storing the data generated during an operation process.

An input/output unit (I/O) 55 is arranged in the control section 50 to acquire various input data from the host computer 70 and export a control output of the control section 50 to the host computer 70. The I/O 55 is connected with the CPU 51, the ROM 53 and the RAM 54 via a bus line.

The I/O 55 is connected with a first, a second, a third, a fourth, a fifth, a sixth, a seventh, an eighth, a ninth, a tenth, an eleventh, a twelfth and a thirteenth drivers 56, 57, 58, 59, 60, 61, 62, 63, 64, 65, 66, 67 and 68 serving as units for exporting a control output.

The first driver 56 supplies a required drive output for the first printing section 13. The second driver 57 supplies a required drive output for the second printing section 26. The third driver 58 supplies a drive output for the feed roller 6. The fourth driver 59 supplies a drive output for the alignment section 8. The fifth driver 60 supplies a drive output for the MS reading/writing section 9. The sixth driver 61 supplies a drive output for the PLF section 10. The seventh driver 62 supplies a drive output for the feed roller 22. The eighth driver 63 supplies a drive signal for the cutter 27. The ninth driver 64 supplies a drive signal for the flapper 28. The tenth driver 65 supplies a drive output for the collection sensor 31. The eleventh driver 66 supplies a drive signal for the display section 32. The twelfth driver 67 supplies a drive signal for the page turning mechanism 40. The thirteenth driver 68 supplies a drive signal for the feed roller 42.

The operations of the printer apparatus 1 are described below with reference to FIG. 1, and FIG. 3-FIG. 5. The printer apparatus 1 is used in a state of being incorporated in an automated teller machine and the like.

The user carries out transaction processing with the external server 80 such as a financial institution through operation on the screen of the automated teller machine (not shown). The user may desire to or not to print the transaction processing content on a passbook in different cases, however, in the present embodiment, it is assumed that the user desires to print the content on the passbook.

The automated teller machine requests, through a screen display and the like, the user to open the booklet P serving as the passbook and insert the opened booklet P from the insertion and discharging port 2. The user opens the booklet P and inserts the opened booklet P from the insertion and discharging port 2 towards the rear direction of the printer apparatus 1 (S1).

At this time, the feed roller 6 and the idler roller 7 are rotated in a rotation direction for conveying the booklet P in the conveyance direction A, and the booklet P clamped by the roller pair (feed roller 6 and idler roller 7) at the most upstream side in the conveyance direction A is started to be conveyed in the conveyance direction A.

The booklet P, if being conveyed in the conveyance direction A, enters the alignment section 8 first. The alignment section 8, which consists of a paper position detection sensor, a shutter, a paper pinch mechanism, an alignment end wall (none is shown) and the like, corrects the skew, misalignment and the like of the booklet P inserted from the insertion and discharging port 2 and moves the booklet P to a preset position and attitude (S2). The alignment method of the booklet P is well-known, and therefore the detailed description thereof is omitted.

The booklet P moved to the preset position and attitude is further conveyed in the conveyance direction A and then enters the MS reading/writing section 9. A magnetic stripe is arranged in the booklet P at the side of the MS reading/writing section 9. For example, customer information and information indicating the time of latest printed transaction amount of this booklet P is recorded in the magnetic stripe as magnetic data, and the MS reading/writing section 9 acquires the information recorded in the magnetic stripe while the booklet P is being conveyed in the conveyance direction A (S3). In addition, the information indicating the time of latest printed transaction amount of this booklet P is not limited to be recorded in the magnetic stripe, and it may be recorded in the external server 80.

The booklet P is further conveyed in the conveyance direction A, and then enters the PLF section 10. The PLF section 10 has a function of optically recognizing the current opened page and the printed lines of the booklet P serving as a passbook, and the page number and the information of the printed lines of the booklet P can be acquired by passing the booklet P through the PLF section 10 (S4).

Next, the control section 50 compares the information acquired by the PLF section 10 with the information indicating the time of latest printed transaction amount of this booklet P acquired by the MS reading/writing section 9, to determine whether or not the user inserts the opened booklet P into the printer apparatus 1 with the correct page opened (S5). The "correct page" mentioned herein refers to a page having blank lines to print information in. If a page having no blank line to print information in, that is, a page all the lines in which are printed is opened, or if other new page is opened though there is a page having blank lines to print information in before the opened page, it is determined that the booklet P is inserted with the incorrect page opened.

If it is determined that the booklet P is not inserted with the correct page opened (NO in S5), the feed roller 6 is rotated to convey the booklet P in the conveyance direction A (S6). The booklet P passing through the first printing section 13 and the mergence section 29 reaches the page turning mechanism 40. At this time, since the degree of difference between the current correct page and the page which is opened actually of the booklet P is already known, the page turning mechanism 40 turns the page so that the correct page is opened (S7). In addition, as to the page turning mechanism, a well-known technology is used, and therefore the detailed description thereof is omitted.

The booklet P the correct page of which is opened is conveyed in the conveyance direction B (S8), and is stopped at the printing position of the first printing section 13.

If it is determined that the booklet P is inserted with the correct page opened (YES in S5), the booklet P is conveyed in the conveyance direction A and stopped at the printing position of the first printing section 13. Next, the first printing section 13 carries out printing of one line on the booklet P (S9).

Then the control section 50 confirms whether or not all the printing is completed (S10). Generally, the printing carried out on the booklet P is one line in one transaction processing. However, in a case where there remains unprinted information to be printed on the booklet P, a plurality of lines of printing including the remained unprinted information and the information in the current transaction processing needs to be carried out. In order to print all the information including the remained unprinted information, it is confirmed whether or not all the printing is completed herein.

If all the printing is not competed (NO in S10), the control section 50 determines whether or not the printing can be carried out in the next line (S11). That is because the printing cannot be continuously carried out in the page if, for example, the printing in S9 is carried out in the last printable line of the opened page of the booklet P. Thus, it is determined whether or not the printing can be carried out in the next line.

If it is determined that the printing can be carried out in the next line (YES in S11), the printing is carried out in the next line by the first printing section 13. The printing is carried out until all the printing is completed.

If it is determined that the printing cannot be carried out in the next line (NO in S11), that is, there remains information to be printed even if the printing is carried out in the last printable line of the opened page of the booklet P, the control section 50 confirms whether or not there is a printable page in the booklet P (S12).

If it is determined that there is a printable page (YES in S12), the feed roller 6 is rotated to convey the booklet P in the conveyance direction A (S13). The booklet P passing through the first printing section 13 and the mergence section 29 reaches the page turning mechanism 40. The page turning mechanism 40 turns the page of the booklet P to the next page (S14), and then the booklet P is conveyed in the conveyance direction B (S15), and is stopped at the printing position of the first printing section 13. Then the first printing section 13 starts the printing on the next page.

If it is determined that there is no printable page (NO in S12), the printing is carried out in the last line of the last page of the booklet P, thus, the booklet P is returned to the user. First, the control section 50 rotates the feed roller 6 to convey the booklet P in the conveyance direction B (S16), and stops the booklet P at a position where the booklet P on the insertion and discharging table 30 is detected by the collection sensor 31 and part of the booklet P is clamped between the feed roller 6 and the idler roller 7.

The collection sensor 31 is arranged above the insertion and discharging port 2 to detect the existence of the booklet P or the later-described business form C on the first paper conveyance path 5 nearby the insertion and discharging port 2. If the existence of the booklet P or the business form C is detected, the collection sensor 31 outputs an ON-signal, otherwise, the collection sensor 31 outputs an OFF-signal.

If the booklet P is detected by the collection sensor 31, the control section 50 starts the timer 52 (S17). Then the control section 50 confirms whether or not the booklet P is taken away by the user (S18). The confirmation on whether or not the booklet P is taken away by the user is carried out by confirming the signal of the collection sensor 31, and if the OFF-signal is output, it is determined that the booklet P is taken away by the user.

The signal of the collection sensor 31 is confirmed, and if the OFF-signal is output, it is determined that the booklet P is taken away by the user (YES in S18).

If the signal of the collection sensor 31 is confirmed, and as a result, the ON-signal is output, it is determined that the booklet P is not taken away by the user (NO in S18), and then the control section 50 confirms whether or not a given time elapses from the moment the timer 52 is started when the booklet P is detected by the collection sensor 31 (S19). The given time is a time used to determine that the user forgets to take away the booklet P if the booklet P is still at the position detected by the collection sensor 31 after the time elapses, and the time can be randomly determined by the setter of the printer apparatus 1.

The control section 50 confirms whether or not the given time elapses according to the timer 52 (S19), and if it is determined that the given time does not elapse (NO in S19), there is a possibility that the user takes away the booklet P, thus, it is re-confirmed whether or not the booklet P is taken away (S18). It is confirmed whether or not the given time elapses according to the timer 52 (S19), and if the given time elapses (YES in S19), it is determined that the user forgets to take away the booklet P.

Since personal information, transaction information and the like is recorded in the booklet P, it is necessary to prevent the booklet P from being given to other person by mistake, thus, if it is determined that the user forgets to take away the booklet P, the feed roller 6 is rotated to convey the booklet P in the conveyance direction A through cooperation with the idler roller 7 (S20), and the booklet P passing through the mergence section 29 and the page turning mechanism 40 is collected in the collection box 14 (S21).

If the booklet P is collected (S21) or if it is determined that the booklet P is taken away by the user (YES in S18), the control section 50 rotates the flapper 28 anticlockwise through the flapper rotation mechanism (not shown) (S22) to communicate the second paper conveyance path 21 with the first paper conveyance path 5.

Then the control section 50 drives the new booklet issuing section 41 (S23) to convey a newly issued booklet P2 held in the booklet holder 43 towards the second paper conveyance path 21 from the lower end through the feed roller 42. The issuance of a new booklet is started after it is confirmed whether or not the user takes away the returned booklet P of which all the lines of all the pages are printed. That is, if the user does not forget to take away the booklet P of which all the lines of all the pages are printed, the new booklet issuing section 41 may be driven without confirming whether or not the user takes away the booklet P. However, if the user forgets to take away the booklet P of which all the lines of all the pages are printed, it is necessary to collect the booklet P. In a case of collection, the booklet P is conveyed in the conveyance direction A, and at this time, if the newly issued booklet P2 is already on the first paper conveyance path 5, the booklet P on the first paper conveyance path 5 collides with the newly issued booklet P2. In order to avoid such a situation, the issuance of a new booklet is started after it is confirmed whether or not the user takes away the booklet P.

Further, the newly issued booklet P2 held in the booklet holder 43 is overlaid in a state in which the first page is opened in advance. In this way, when a new booklet is issued, it is not necessary to convey the newly issued booklet P2 to the page turning mechanism 40 to turn the front cover, which saves the processing time, thus, a new booklet can be issued in a short time.

The newly issued booklet P2 inserted in the second paper conveyance path 21 is further conveyed in the conveyance direction B through the cooperation between the feed roller 22 and the idler roller 23 and is stopped at the printing position of the first printing section 13 (S24). Next, the first printing section 13 carries out printing of one line on the booklet P (S9).

The control section 50 confirms whether or not all the printing is completed (S10), and if it is determined that all the printing is competed (YES in S10), the control section 50 conveys the booklet P in the conveyance direction B towards the insertion and discharging port 2 through the cooperation between the feed roller 22 and the idler roller 23 (S25). During the conveyance towards the insertion and discharging port 2, when the booklet P passes through the MS reading/writing section 9, the MS reading/writing section 9 writes the newest information such as the current transaction information and the like in the magnetic stripe arranged in the booklet P (S26), and then the booklet P is further conveyed in the conveyance direction B towards the insertion and discharging port 2. Then the booklet P is conveyed to a position where the front end thereof cannot be detected by the collection sensor 31 and stopped on the first paper conveyance path 5.

Next, the control section 50 conveys the roll paper 15 in the conveyance direction B through the cooperation between the feed roller 22 and the idler roller 23 and prints the content of the current transaction processing on the roll paper 15 through the second printing section 26 (S27). After the printing of the content of the current transaction processing is completed, the cutter 27 is driven to cut the roll paper 15 (S28) to complete the business form C. Then, the feed roller 22 and the feed roller 6 are driven to convey the business form C in the conveyance direction B towards the insertion and discharging port 2 (S29).

If it is detected by a sensor (not shown) that the business form C reached the MS reading/writing section 9, the control section 50 conveys the business form C to a position where the front end of the business form C cannot be detected by the collection sensor 31, and then conveys the booklet P stopped on the first paper conveyance path 5 in the conveyance direction B (S30), and stops the booklet P on the insertion and discharging table 30 at a position where the booklet P is detected by the collection sensor 31 and part of the booklet P is clamped between the feed roller 6 and the idler roller 7. In addition, as the business form C is conveyed in the conveyance direction B as it is, the business form C is overlaid on the booklet P.

If the booklet P is detected by the collection sensor 31, the control section 50 starts the timer 52 (S31). Then the control section 50 confirms whether or not the booklet P and the business form C are taken away by the user (S32). The confirmation on whether or not the booklet P and the business form C are taken away by the user is carried out by confirming the signal of the collection sensor 31 as stated above. After the signal of the collection sensor 31 is confirmed, and as a result, the OFF-signal is output, it is determined that the booklet P and the business form C are taken away by the user (YES in S32), and then the current processing is ended (S33).

If the signal of the collection sensor 31 is confirmed, and as a result, the ON-signal is output, it is determined that the booklet P and the business form C are not taken away by the user (NO in S32), the control section 50 confirms whether or not a given time elapses from the moment the timer 52 is started when the booklet P is detected by the collection sensor 31 (S34). Similarly, the given time is a time used to determine that the user forgets to take away the booklet P and the business form C.

The control section 50 confirms whether or not the given time elapses according to the timer 52 (S34), and if it is determined that the given time does not elapse (NO in S34), there is a possibility that the user takes away the booklet P and the business form C, thus, it is re-confirmed whether or not the booklet P and the business form C are taken away (S32). It is confirmed whether or not the given time elapses according to the timer 52 (S34), and if the given time elapses (YES in S34), it is determined that the user forgets to take away the booklet P and the business form C, thus, the control section 50 stops the operation of the flapper rotation mechanism (not shown). As stated above, usually, the flapper 28 provided with the energization module (not shown) is energized clockwise by the energization module, thus, if the operation of the flapper rotation mechanism is stopped, the flapper 28 is rotated clockwise by the energization module (S35), and therefore the first paper conveyance path 5 from the insertion and discharging port 2 to the collection box 14 is communicated. Next, the control section 50 rotates the feed roller 6 to convey the business form C and the booklet P in the conveyance direction A through the cooperation with the idler roller 7 (S36), and passes the business form C and the booklet P through the mergence section 29 and the page turning mechanism 40 to collect the business form C and the booklet P in the collection box 14 (S37), and then the current processing is ended (S38).

As stated above, in the present embodiment, the printer apparatus is provided with an insertion and discharging port; a first paper conveyance path configured to convey a first printing medium in a form of booklet inserted from the insertion and discharging port in a downstream direction towards a given printing position, and convey the first printing medium in a direction opposite to the downstream direction to discharge the first printing medium from the insertion and discharging port; a first printing section configured to carry out printing on the first printing medium conveyed to the printing position; a second printing section configured at the downstream side of the first printing section when seen from the direction of the insertion and discharging port to carry out printing on a second printing medium in a printing method different from that of the first printing section; a second paper conveyance path configured to merge with the first paper conveyance path at the downstream side of the first printing section of the first paper conveyance path to discharge the printed second printing medium through the first paper conveyance path from the insertion and discharging port; and a new booklet issuing section configured to insert an unused first printing medium in the second paper conveyance path as a newly issued medium.

In this way, even in a case where the printable area of the first printing medium is used up though there still remains data to be printed on the first printing medium, the user can get a newly issued first printing medium without waiting at the window, in addition, since the second paper conveyance path is used to issue the first printing medium, the whole size of the printer apparatus can be reduced compared with a case where a dedicated new first printing medium issuing machine is arranged.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer apparatus, comprising:

an insertion and discharging port;

a first paper conveyance path configured to convey a first printing medium in a form of booklet inserted from the insertion and discharging port in a downstream direction towards a given printing position, and convey the first printing medium in a direction opposite to the downstream direction to discharge the first printing medium from the insertion and discharging port;

a first printing section configured to carry out printing on the first printing medium conveyed to the printing position;

a second printing section configured at the downstream side of the first printing section when seen from the direction of the insertion and discharging port to carry out printing on a second printing medium in a printing method different from that of the first printing section;

a second paper conveyance path configured to merge with the first paper conveyance path at the downstream side of the first printing section of the first paper conveyance path to discharge the printed second printing medium through the first paper conveyance path from the insertion and discharging port; and a new booklet issuing section configured to insert an unused first printing medium in the second paper conveyance path as a newly issued medium.

2. The printer apparatus according to claim 1, wherein the new booklet issuing section is arranged at the upstream side of the second printing section in a conveyance direction of the second printing medium conveyed towards the first printing section.

3. The printer apparatus according to claim 1, wherein the first printing section carries out printing in a dot matrix printing method and the second printing section carries out printing in a thermal printing method.

4. The printer apparatus according to claim 1, further comprising:

a collection box configured at the downstream side of a page turning mechanism, which is arranged at the downstream side of a mergence section of the first paper conveyance path and the second paper conveyance path and has a function of turning the page of the first printing medium, to collect the first printing medium and the second printing medium a user forgets to take away.

* * * * *